United States Patent [19]

Fisch

[11] Patent Number: 4,669,297

[45] Date of Patent: Jun. 2, 1987

[54] PRESS DIE LIFTER RAIL

[75] Inventor: Alfred C. Fisch, Clarkston, Mich.

[73] Assignee: Oakland Engineering Inc., Pontiac, Mich.

[21] Appl. No.: 845,232

[22] Filed: Mar. 28, 1986

[51] Int. Cl.[4] ..... B21J 13/08

[52] U.S. Cl. ..... 72/448; 72/446; 100/918; 384/58

[58] Field of Search ..... 72/446, 448, 420, 481, 72/482, 419; 100/295, 918, 229 R; 384/10, 50, 57, 58, 59

[56] References Cited

U.S. PATENT DOCUMENTS

| | | | |
|---|---|---|---|
| 3,139,676 | 7/1964 | Grover | 100/918 |
| 4,258,620 | 3/1981 | Sallander | 72/446 |
| 4,317,358 | 3/1982 | Yonozawa et al. | 72/448 |
| 4,459,909 | 7/1984 | Takagi | 100/918 |

FOREIGN PATENT DOCUMENTS

| | | | |
|---|---|---|---|
| 84234 | 6/1980 | Japan | 72/448 |

*Primary Examiner*—Robert L. Spruill
*Assistant Examiner*—David B. Jones
*Attorney, Agent, or Firm*—Barnes, Kisselle, Raisch, Choate, Whittemore & Hulbert

[57] ABSTRACT

A die lifter rail adapted to be inserted into the open end of a conventional inverted T-slot in the bolster plate of a press has a narrow support bar dimensioned to extend lengthwise within the narrower stem portion of the T-slot and a plurality of sets of vertically stacked Belleville springs spaced lengthwise of the support bar and resiliently supporting it for vertical movement. The Belleville springs have a diameter substantially greater than the width of the support bar and corresponding generally to the width of the wider base portion of the t-slot. Studs extending vertically upwardly through the Belleville springs have a sliding fit with bores in the support bar to guide its vertical movement. A plurality of longitudinally spaced rollers are journalled in the support bar and project above the upper face thereof to support a die for sliding movement on the press bolster plate.

6 Claims, 5 Drawing Figures

PRESS DIE LIFTER RAIL

This invention relates to lifter rails for press dies.

In metal working presses dies are frequently removed and replaced either for repair or for producing a different workpiece. The operation of removing and replacing such dies is frequently laborious and time consuming because of the size and weight of the dies. It is therefore very desirable to provide mechanisms which enable dies to be removed from and arranged on the bolster plate of a press with a minimum amount of time and effort.

Various mechanisms have been proposed in the prior art to facilitate the handling of dies by raising the die up off of the bolster plate on rollers. Many of these mechanisms, however, are either embedded in the bolster plate itself, as in Sallander U.S. Pat. No. 4,258,620 and Abe et al U.S. Pat. No. 4,152,978, or lie in a specially formed groove in the surface of bolster plate, as in Ellrich U.S. Pat. No. 2,913,946 and Yonezawa U.S. Pat. No. 4,301,673. Such arrangements require custom bolster plates which are generally very costly.

Other prior art mechanisms, like the present invention, have used the conventional inverted T-slots in the surface of the bolster plate. For example, Yonezawa U.S. Pat. No. 4,317,358 shows a spring-loaded lifter rail which may be inserted into the T-slot and bolted to the bolster plate. In that arrangement vertically oriented compression springs extend upwardly through the narrow stem of the T-slot. The springs are therefore of relatively small diameter and the load carrying capacity of each spring is, therefore, quite limited.

The primary object of this invention is to provide a die lifter rail which may be inserted into a standard T-slot in the bolster plate and in which the individual springs are adapted to support very heavy loads.

Another object of this invention is to provide a structurally strong die lifter rail of simple design, economical construction and adapted for long periods of use without requiring servicing.

In general the lift rail of the present invention comprises a rigid support bar adapted to be supported within the narrow stem portion of a conventional inverted T-slot of a bolster plate by means of a plurality of vertically compressible springs. The springs which support the support bar are substantially wider than the narrow stem portion of the T-slot and are seated at the bottom of the T-slot in the wider base portion thereof. The support bar is guided for vertical movement by means of upstanding guide pins which locate the compression springs in the wider portion of the T-slot. The support bar has a plurality of vertical through slots spaced along its length in which rollers are journalled and on which the die is adapted to be supported for sliding movement over the bolster plate. In the preferred form of the invention the springs are in the form of Belleville spring washers.

Other objects, features and advantages of the present invention will become obvious to one skilled in the art from the following description and accompanying drawing, in which.

Figure 5:
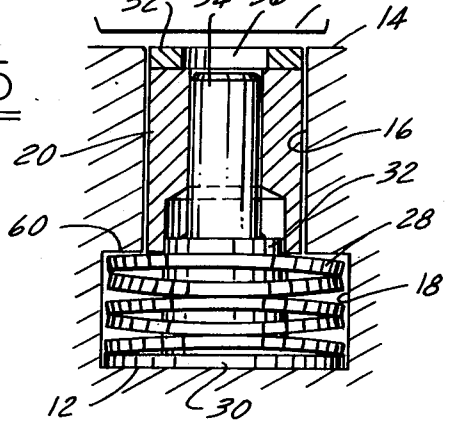
FIG. 5 is a sectional view along the line 5—5 in FIG. 2.

The lifter rail of the present invention is generally designated 10 and is designed to be arranged within the T-slot 12 of a press bolster plate 14. The T-slot 12 has a narrow upstanding stem portion 16 and a wider base portion 18. The lifter rail 12 includes a rigid metal bar 20 that is provided with a plurality of vertical through slots and bores to accommodate various components of the assembled lifter rail. The circular bores are designated 22 and are counterbored as at 24. At their lower ends these bores are enlarged as at 26, the diameter of the enlarged portions 26 being substantially greater than the width of bar 20. The enlarged portions 26 are designed to accommodate a plurality of vertically stacked Belleville spring washers 28. As is shown in FIG. 5, the outer diameter of washers 28 is only slightly less than the width of the wider base portion 18 of T-slot 12. Washers 28 are seated on a disc 30 having a diameter corresponding generally to the outer diameter of washers 28. Washers 28 are stacked vertically around a central guide bushing 32. The outer diameter of bushing 32 is slightly smaller than the inner diameter of spring washers 28. Within the guide bushing 32 there is arranged an upstanding guide stud 34 having a close sliding fit with the cylindrical bore 22. At its lower end stud 34 is secured to disc 30. At its upper end guide bushing 32 is secured to stud 34. With the above-described arrangement the support bar 20 is resiliently supported on the stacked springs 28 within the T-slot 12 and with the lower face 36 of bar 20 spaced above the bottom of the base portion 18 of slot 12. The extent of vertical movement of bar 20 relative to studs 34 is limited by a flat 38 in each stud 34 engaged by a roll pin 40 extending through bar 20.

Figure 1:
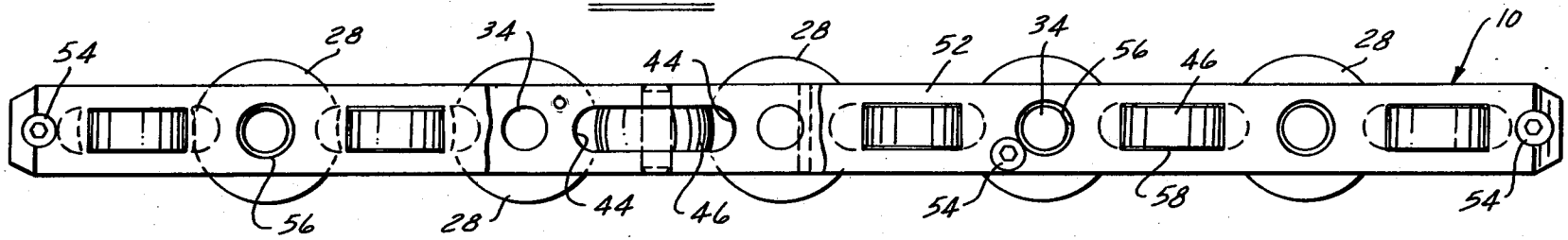
FIG. 1 is a top plan view of a lifter rail according to the present invention.
Figure 2:
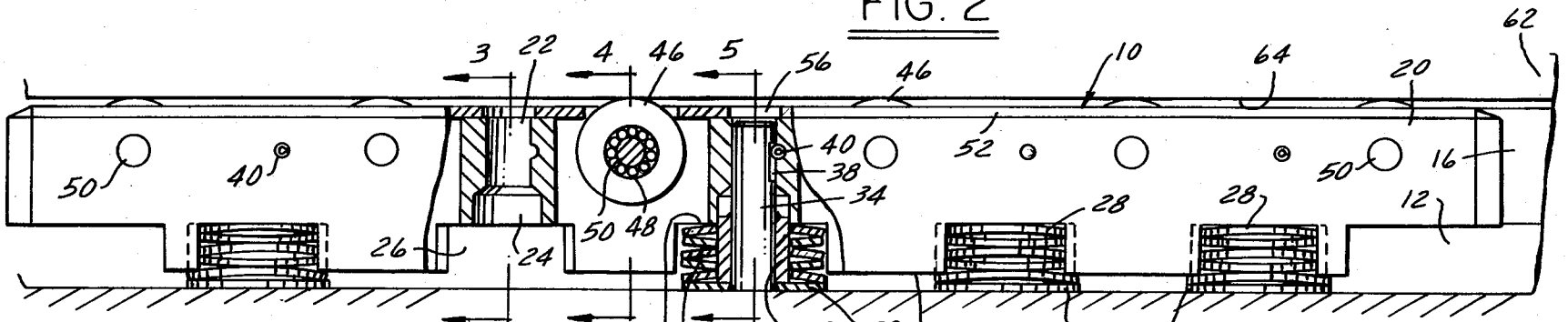
FIG. 2 is a side elevational view of the lifter rail with some parts removed and other parts in section and arranged within the inverted T-slot of a press bolster plate.
Figure 4:
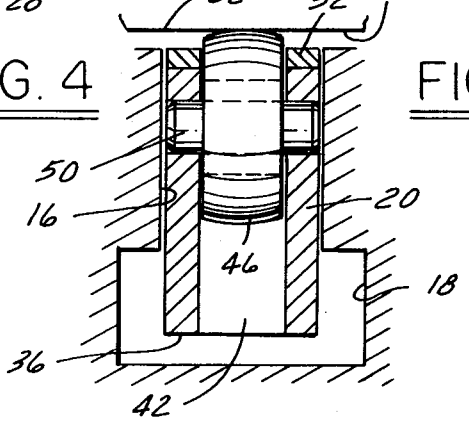
FIG. 4 is a sectional view along the line 4—4 in FIG. 2.
Figure 3:
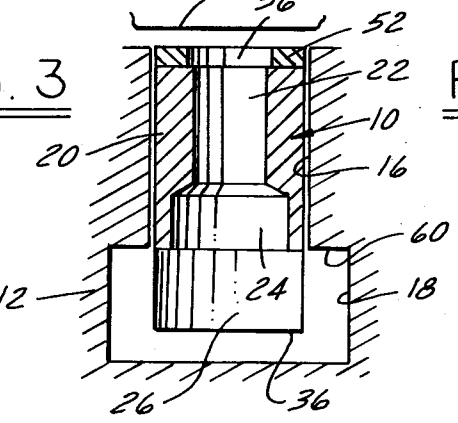
FIG. 3 is a sectional view along the line 3—3 in FIG. 2.

The vertical through slots in bar 20 are designated 42. These slots are elongated in a direction lengthwise of bar 20 and have rounded opposite ends 44. Within each slot 42 there is journalled a roller 46. Each roller 46 is rotatably supported by means of a bearing 48 on a shaft 50. A cover plate 52 is secured to the top face of bar 20 as by screws 54. Cover plate 52 has a series of round openings 56 vertically aligned with studs 34 and rectangular openings 58 which have a rather close fit with the upwardly projecting portions of rollers 46. As is apparent from FIGS. 2 and 4, rollers 46 are journalled on bar 20 so that they project upwardly above the top face of cover plate 52.

In use the lifter rails 10 are arranged within the inverted T-slots of a press bolster plate by sliding the rails into slots 12 from one end thereof. As pointed out previously, when the rails 10 are so arranged within the T-slots, the stacked springs 28 in each set fit nicely within the wider base portion 18 of the T-slots and the bar 20 projects upwardly therefrom through the narrow stem portion 16 of the T-slots. In the embodiment illustrated five spring washers 28 are utilized in each stack and their combined height, together with the thickness of d,isc 30, is equal to approximately the vertical extent of the wider base portion 18 of the T-slot. Bar 20 is supported on spring washers 28 by means of the horizontal shoulder 60 that is formed between the counterbore 24 and the enlarged bore 26 at the lower end of each vertical bore 22. The vertical dimension of bar 20 is such that, when the lifter rail is assembled in the T-slot, the top face of cover plate 52 is substantially flush with the top face of the bolster plate 14. The upper end of each stud 34 is spaced below the top face of cover plate 52 a distance at least slightly greater than the extent to which rollers 46 project upwardly beyond the top face of cover plate 52.

The number and size of spring washers 28 on each lifter rail 12 are determined such that they will support any die 62 intended to be used on the press in a position elevated at least slightly above the top face of bolster plate 14. Thus the die 62 can be rolled onto or off of the bolster plate with little effort. When the die is rolled onto the bolster plate springs 28 will compress to some extent, but, as pointed out previously, the number and size of these springs are such that the bottom face 64 of the die 62 will not contact the top face of the bolster plate until the die is clamped down on the bolster plate by suitable clamps (not shown).

It will be observed that the construction of the lifter rail is such that it is structurally very strong. Bar 20 is accurately guided for vertical movement by means of the sliding engagement of bushings 32 with counterbores 24 and studs 34 with bores 22. The tendency for bar 20 to tilt and bind on studs 34 is therefore minimal. Cover plate 52 is designed to prevent dirt, chips, etc. in the press environment from interferring with the free rotary movement of rollers 46. Furthermore, since the bores 42 in which rollers 46 are located extend directly through bar 20, any dirt or chips that might fall through openings 58 is permitted to drop down to the bottom of the T-slots.

I claim:

1. A die lifter rail adapted to be positioned in the inverted T-slots in the bolster plate of a press comprising, a support bar dimensioned to extend lengthwise within the narrow upstanding stem portions of the T-slot, a plurality of annular compression spring members spaced lengthwise beneath and seated on a base resiliently supporting the support bar, said spring members each having a lateral dimension greater than the width of the support bar and corresponding generally with the width of the wider base portion of the T-slot, said support bar having a plurality of longitudinally spaced slots therein and rollers journalled in said slots for rotation about horizontal axes, said axes being spaced below the upper face of the support bar by a distance less than the radial dimension of said rollers, said bar havinq a vertical first bore concentric with each sprinq member, a stud affixed to and projecting upwardly from said base through the sprinq member and slidablv engaginq the associated first bore for vertically quidinq the support bar in the T-slot, said bar further having a plurality of second bores therein each concentric with a first bore, the diameter of the second bores being greater than the width of said bar, said spring members being disposed within said second bores, the lower ends of the first bores being connected to the upper ends of the second bores by a horizontally extending shoulder, the upper ends of said spring members engaging said shoulders to resiliently support the bar, and means interconnectinq said studs and said bar to limit relative vertical movement therebetween, said interconnecting means comprising first means affixed to said bar and projecting into said first bore and second means on stud slidably embracing said first means.

2. A die lifter rail as called for in claim 1 wherein the vertical dimension of each set of vertically stacked spring washers corresponds generally with the vertical dimension of the wider base portion of the T-slot.

3. A die lifter rail as called for in claim 2 wherein said bar is provided with a plurality of third bores concentric with and vertically intermediate the first and second bores, said third bores having a diameter greater than the first bores and corresponding generally to the internal diameter of said spring members, the lower portion of each stud being radially enlarged and having a close fit with said third bores.

4. A die lifter rail as called for in claim 3 wherein each of said spring members comprises a plurality of vertically stacked Belleville washers.

5. A die lifter rail as called for in claim 4 wherein said slots have a dimension in a direction lengthwise of said bar greater than the diameter of said rollers and including a cover plate secured to the upper face of said support bar and having openings therein which have a relatively close fit with the portions of the rollers extending upwardly above the top face of the support bar.

6. A die lifter rail as called for in claim 5 wherein said slots extend vertically through said bar.

* * * * *